US005212493A

United States Patent [19]

Cluniat et al.

[11] Patent Number: 5,212,493

[45] Date of Patent: May 18, 1993

[54] ANTENNA SYSTEM FOR RECEPTION FROM DIRECT BROADCASTING SATELLITES

[75] Inventors: Claude Cluniat, Aubergenville; Maurice Loiseau, Courbevoie; Guy Bastard, Garches; Jean-Jacques Lombard, Montigny Le Bretonneux, all of France

[73] Assignee: Thomson-LGT Laboratoire General Des Telecomm., Confians-Saint-Honorine, France

[21] Appl. No.: 837,694

[22] Filed: Feb. 19, 1992

Related U.S. Application Data

[63] Continuation of Ser. No. 480,483, Feb. 16, 1990, abandoned.

[30] Foreign Application Priority Data

Feb. 17, 1989 [FR] France ..... 89 02082

[51] Int. Cl.[5] ..... H01Q 3/080; H01Q 1/120

[52] U.S. Cl. ..... 343/765; 343/882

[58] Field of Search ..... 343/757, 763, 765, 840, 343/878, 880, 882; 248/183

[56] References Cited

U.S. PATENT DOCUMENTS

| | | | |
|---|---|---|---|
| 2,945,229 | 7/1960 | Klauser | 343/754 |
| 3,184,747 | 5/1965 | Kach | 343/840 |
| 4,617,572 | 10/1986 | Hugo | 343/765 |
| 4,626,864 | 12/1986 | Micklethwaite | 343/882 |
| 4,628,323 | 12/1986 | Crean | 343/765 |

FOREIGN PATENT DOCUMENTS

| | | | |
|---|---|---|---|
| 0244969 | 11/1987 | European Pat. Off. | 343/878 |
| 3125593 | 5/1983 | Fed. Rep. of Germany | 343/882 |
| 2471058 | 6/1981 | France | 343/878 |
| 0013544 | 1/1980 | Japan | 343/882 |
| 0180204 | 9/1985 | Japan | 343/882 |
| 0257601 | 12/1985 | Japan | 343/880 |
| 2178904 | 2/1987 | United Kingdom | 343/840 |

*Primary Examiner*—Rolf Hille
*Assistant Examiner*—Peter Toby Brown
*Attorney, Agent, or Firm*—Cushman Darby & Cushman

[57] ABSTRACT

The antenna system for direct broadcasting satellite reception is formed by a parabolic reflector associated with source means, the reflector being positioned and held by means of a supporting foot formed by a hollow, tubular body fixed at its upper part to the rear central zone of the reflector and hinged at its lower part to a pedestal around a horizontal axis to define the elevation of the antenna. The pedestal includes a rotationally movable part to define the azimuth of the antenna. The tubular body of the pedestal supports a section sufficient to contain all the circuits associated with the antenna.

6 Claims, 2 Drawing Sheets

ANTENNA SYSTEM FOR RECEPTION FROM DIRECT BROADCASTING SATELLITES

This is a continuation of application Ser. No. 07/480,483, filed on Feb. 16, 1990, which was abandoned upon to filing hereof.

BACKGROUND OF THE INVENTION

1. Field of the Invention

The invention pertains to the field of reception from direct broadcasting TV satellites and, more particularly, to a reception antenna system.

2. Description of the Prior Art

In the field of reception from direct broadcasting satellites (D.B.S.) such as TDF 1, TV SAT, OLYMPUS, BSD etc., different sorts of known antennas may be used.

A first type of known antenna uses a paraboloid of revolution, with a source placed in the focal point of this paraboloid. The antenna access is obtained either directly at the focal point of the parabola, at the source access, or in the rear of the antenna, a crosshead formed by a guide making the connection between the source and the rear of the antenna. The antenna is placed on a support dimensioned as a function of the size of the parabola. This support enables aiming, in azimuth and elevation, towards the satellite to be received.

The drawback of this type of antenna is that the shadow projected from the source, from its support and from its holding arms masks a part of the reflector: this causes a reduction in efficiency. Moreover, the use of a waveguide to have access to the rear of the antenna makes it possible to protect the low-noise converter (LNC) but causes a loss of transmission that implies a reduction in gain and an increase in the noise temperature of the antenna. Furthermore, this is a high-cost type of antenna, notably because of the number of mechanical parts that have to be used to make the antenna structure and enable its orientation. The latest developments in this type of antenna have made it possible, by means of GaAs FETs, to obtain small-sized low-noise converters which it has been possible to place directly behind the source, at the focal point of the paraboloid, so as to reduce the transmission losses. But, in doing this, the mask on the reflector is further increased, notably for small-diameter antennas. Furthermore, the electronic circuitry is then more directly subjected to climatic conditions, especially variations in temperature, and to the vibrations induced.

Another type of known antenna uses an off-centered parabolic reflector and is commonly called an off-set antenna. The reflector of this antenna is formed by a portion of a paraboloid of revolution. The source, which is away from the axis of this paraboloid, projects no shadow on the aperture. To this end, the reflector is obtained by cutting out a paraboloid in a cylinder with a diameter D, centered on an axis parallel to the focal axis of the paraboloid. The source is then placed at the focus F of the paraboloid and is aimed at the middle of the paraboloid portion. The antenna access is generally obtained at the source access, and the low-noise converter, in this case, is placed directly behind the source, before the reflector.

The chief advantage of this "off-set" structure is the increase in the efficiency of the antenna through a reduction in the mask effect of the source. Moreover, the antenna has little sensitivity to climatic conditions and, by its structure, the antenna aimed towards the satellite is practically vertical. However, this second type of antenna also has major drawbacks: the making of this type of reflector, which is not of a shape generated by revolution, is difficult and little suited to fabrication by metal-spinning or drawing. Moreover, the radiation patterns of the antenna are not generated by revolution and the rate of ellipticity of an antenna such as this, used in circular polarization, is higher than with an antenna using a reflector in the shape of a paraboloid of revolution. Besides, the low-noise converter is placed before the reflector, and is therefore subjected to climatic conditions (temperature in particular). Finally, since the reference plane in elevation is not easily defined, it is not easy to aim the antenna in the direction of the satellite to be received.

SUMMARY OF THE INVENTION

An object of the invention is a compact antenna system, designed to pick up the signals emitted by a satellite, integrating a low-noise converter-amplifier to amplify the signals received by the antenna and to convert them into the requisite band, this antenna being designed to integrate all or a part of the electronic functions needed for the compatibility of reception of the TV images, while at the same time being of very moderate cost and having great aiming simplicity. These characteristics are obtained by means of a very restricted number of elements to achieve:

- the setting in elevation,
- the azimuthal setting,
- the protection and integration of the electronic circuitry,
- and the fixing.

According to the invention, there is proposed an antenna system for direct broadcasting satellite reception, comprising a parabolic reflector, the rear central part of which is fixed to a hollow tubular body of a supporting foot by means of a fixing part, the reflector, the fixing part and the tubular body of the supporting foot having a tube going through them, with the same axis as the reflector, containing the source and forming a protection and means for centering the source in the reflector, the tubular body of the supporting foot being hinged to its base on a horizontal axis borne by a pedestal and associated with locking means that fix the elevation of the antenna, the pedestal being movable in rotation around a vertical axis to fix the azimuth of the antenna, all the circuits of the antenna system and its electrical supply means being fixed to the interior of the tubular body of the supporting foot.

BRIEF DESCRIPTION OF THE DRAWINGS

The invention will be understood more clearly, and other characteristics will appear from the following description, made with reference to the appended figures, wherein.

DESCRIPTION OF PREFERRED EMBODIMENTS

In the following description, the embodiments described in detail are suited to the reception of satellites transmitting in the 11.7 to 12.5 GHz band, in right or left circular polarization. However, the antenna may be modified to be adapted to another frequency band or to other types of polarization.

Figure 1A:
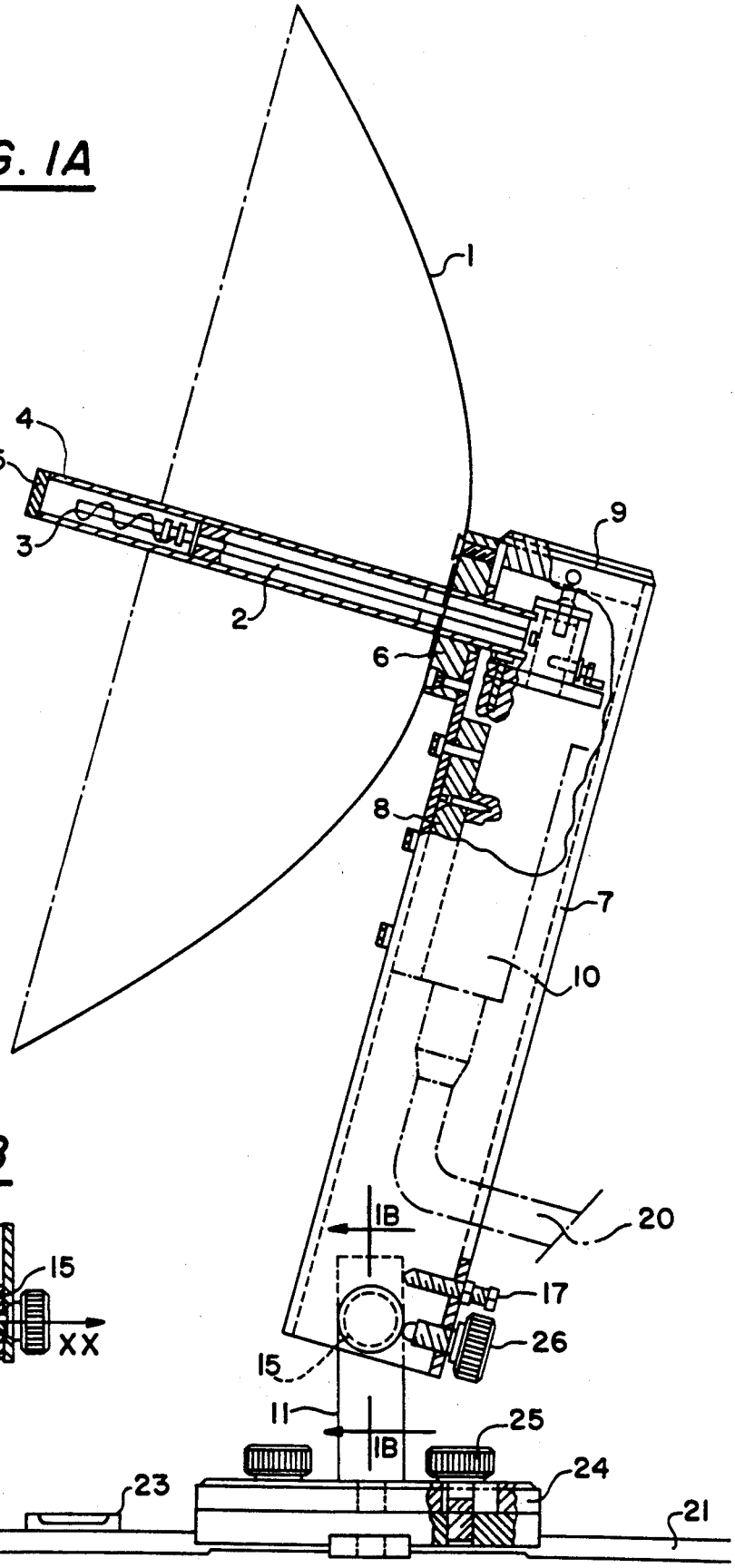
FIG. 1A is a sectional drawing showing a first embodiment of the antenna system according to the invention.

The antenna system according to the invention is formed chiefly by an antenna with its reflector having a diameter adapted to the power received from the satellite and its source, a supporting foot that provides for the geometry of the antenna and simultaneously enables its setting for the aiming of the satellite and electronic circuits, essentially the low-noise converter-amplifier, possibly complemented by other circuits. By way of an example, FIG. 1A represents the embodiment of the antenna system, according to the invention, for the reception of the satellite TDF 1 which radiates power of 63 dBW: the reflector of the antenna is a parabolic reflector with a diameter of 0.33 meters. The system can be adapted to greater diameters for values of power transmitted by other smaller satellites, up to 0.7 meters without modification, for example for the ASTRA satellite which radiates power of 52 dBW.

The reflector 1 is a paraboloid of revolution. The ratio between the focal distance and the diameter of this paraboloid is 0.3, and this fact, given the diameter of 0.33 m., leads to a focal distance of 97 mm. The angle of aperture of the paraboloid is 161 degrees. This reflector is made of aluminium with a thickness of 15/10th of a millimeter, and is obtained by "fluo-turning" for small quantities or by drawing for larger quantities. The tolerance as regards the contour of the reflector leads to a mean square deviation of 0.5 mm. from the theoretical contour. This results in a loss of gain of the order of 0.28 dB at a central frequency F=12.1 GHz. This reflector 1 is directly fixed by its central part to the supporting foot, as shall be explained hereinafter.

The source enables the reception of the circularly polarized signals of the frequency band 11.7 to 12.5 GHz. This source is formed by a semi-rigid coaxial cable 2 with PTFE dielectric, under copper tubing, surmounted by illuminant 3 which uses the properties of radiation of the surface waves: this illuminant 3 takes the form of a helix or of any other source enabling the electronic circuitry to be shifted to the rear of the reflector of the antenna. In the optimized embodiment shown, the illuminant is a helix, the turns of which have been obtained by winding on a 6 mm diameter cylinder with a pitch of 12 mm, the angle of inclination of the turns being 30 degrees. The attenuation provided by the semi-rigid coaxial cable used in the 12 GHz band is of the order of 1.5 dB per meter. For the antenna described, this means a reduction in gain of the order of 0.2 dB. Owing to the structure of the source with respect to the reflector by the source are restricted to 0.01 dB. This source (coaxial cable surrounded by the helical illuminant) is fixed in a polypropylene tube 4 having the same axis as the reflector and going through the center of this reflector. This tube, which is closed at its end on the illuminant side by a cap 5, forms a radome and provides imperviousness to dripping. The measured losses of the radome are at the operating frequencies of 0.2 dB. In the rear of the reflector, the tube 4 is held in position by a centering piece 6 fixed, firstly, to the rear of the reflector and, secondly, to a hollow tube 7 forming the body of the supporting foot. Thus, the rigidity of the supply line is ensured.

Thus, the source is centered in the tube 4 and kept in position by the part 6 centered on the rear of the reflector, which is itself held by means of screws to the body 7 of the supporting foot. Thus, the centering and the longitudinal positioning of the source with respect to the reflector are achieved.

The dimensioning of the body 7 of the supporting tube is such that the reflector can be replaced by simply laying down screws to fix this reflector to the part 6 and, as indicated above, the diameter of the reflectors may be modified.

The supporting foot has three functions:

to provide for the geometry of the antenna as indicated above;

to contain and protect the electronic circuitry needed to process the signals received from the satellite;

enable fast aiming of the antenna, even by a non-specialist.

The assembly formed by the source, supply and conversion head 10 is fixed in the body of the supporting foot 7 by means of a part 8.

The conversion head 10, which is fixedly joined to body 7 of the supporting foot, is shielded from dripping by means of a cover 9 which shields it from adverse weather conditions. This cover 9 closes the upper part of the tube 7 closing the body of the supporting foot. At the opposite end, the tube 7 forming the supporting foot 2 is not closed: this enables a flow of air preventing condensation because of this aperture at the bottom.

The reception access at the output of the supporting foot is obtained by means of a cable 20 fixedly joined to the conversion head 10 and going through an aperture made at the bottom part of the body 7 of the supporting foot.

The assembly formed by the reflector, source and conversion head is compact and contains all the elements needed to pick up the signals from the satellite.

To enable fast aiming of the antenna, even by a non-specialist, the above-described assembly is held on a pedestal by means of two screws 15 that form a hinge on a vertical tube 11 enabling the antenna to swivel around a horizontal axis XX.

The pedestal is formed by two mechanical parts:

a fixed part 21, cross-shaped for example, which is fixed horizontally (or vertically) by means of screws placed in the holes 22 of its arms. On this fixed part, there is placed a level indicator 23 enabling a perfect definition of a horizontal or vertical plane and, hence, the obtaining of a reference plane for the definition of the antenna elevation.

a movable part 24, surmounted by the tube 11, centered in rotation on the fixed part and fixedly joined to this fixed part by means of two screws 25. These screws slide in the facings of the movable part. The locking of these two screws ensures that the azimuthal axis of the antenna is made immobile after the rotation of the movable part 24 around the fixed part 21 has enabled the azimuthal axis to be defined. To pre-position the antenna towards the satellite, a magnetized needle is placed on this moving part as well as an orientation dial.

Figure 1B:
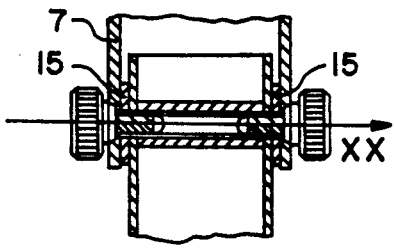
FIG. 1B shows a sectional view along the line 1B—1B in FIG. 1A.

The tube 11 of this movable part supports the body 7 of the oscillating foot on the axis AA XX defined by the two screws 15 shown on the FIG. 1B. The elevational setting of the antenna is done by moving a screw 26 in a maximum sector defined by a movable stop 17. The locking and fixing in position after setting is done by the locking of the screws 15 and of the movable stop.

All the parts of this supporting foot are made of aluminum, and all the shapes adopted are simple shapes that can be obtained by molding or swaging, thus reducing production costs to the minimum. In order to simplify the aiming of the antenna, the positioning pointers placed for the setting of the elevation and azimuthal axes include graduations and, possibly, the indication of the satellites aimed at.

Figure 2A:
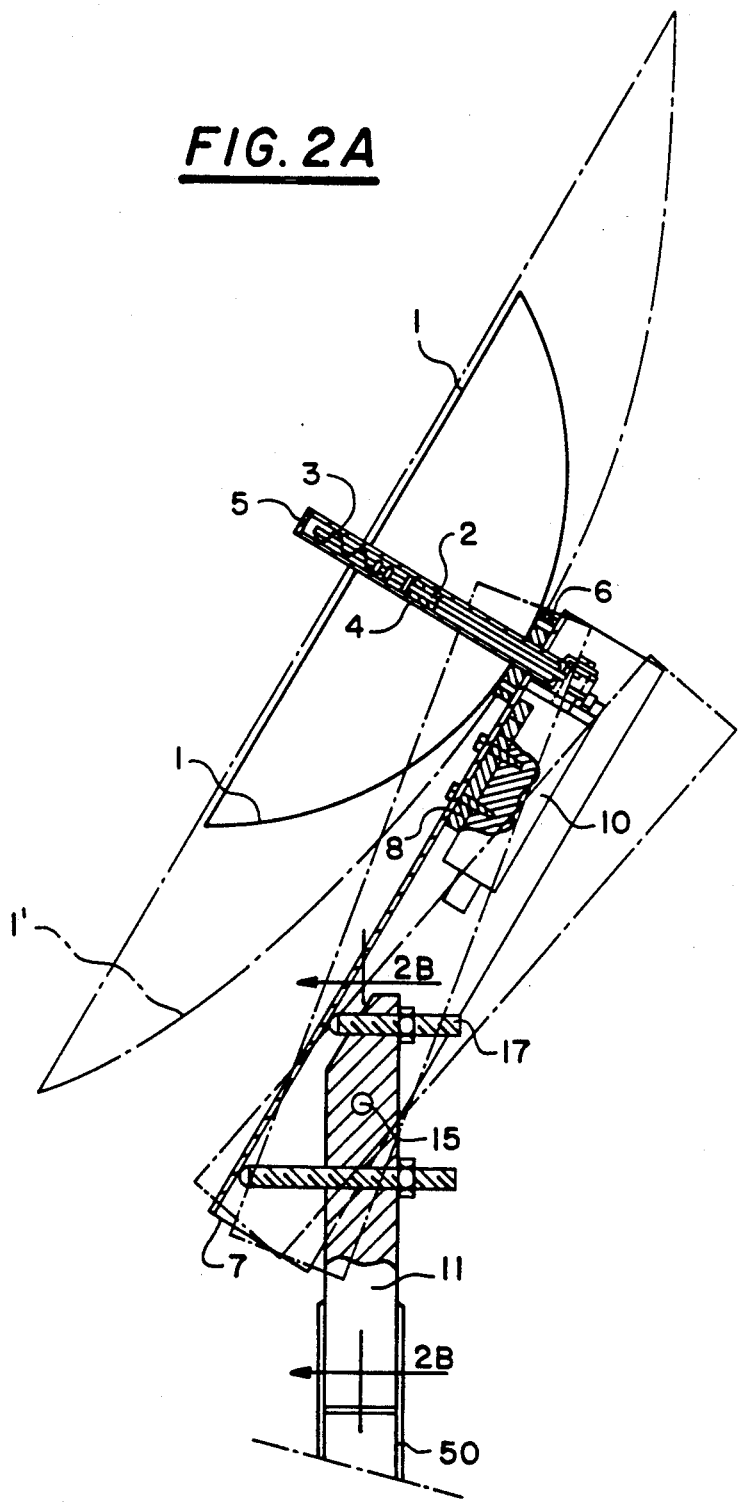
FIG. 2A shows a second embodiment of the system according to the invention.
Figure 2B:
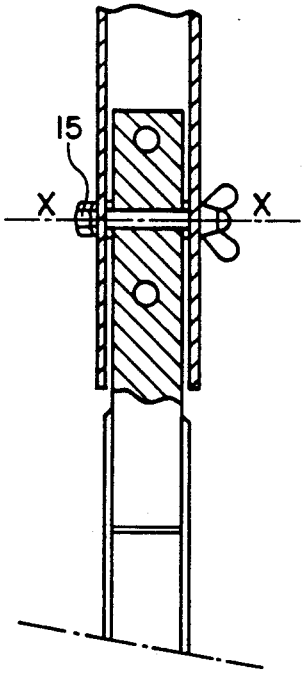
FIG. 2B shows a sectional view along the line 2B—2B in FIG. 2A.

For certain applications, the assembly formed by the movable part 24 and the fixed part 21 of the support can be replaced solely by the cylindrical tube 11, which can be directly fitted into a standard tube, commonly used as a support for radio reception antennas. FIG. 2A shows a thus simplified embodiment of an antenna according to the invention, designed to be fitted directly into a standard tube. The same references are repeated for the same elements as in FIG. 1A.

The essential difference here is that the foot of the supporting tube 11 is directly fitted into a standard supporting tube external to the antenna system 50. Naturally, in this case, the horizontal part of the supporting foot is eliminated, and the reference axis is given directly by the standard tube which, to this effect, is positioned vertically. This figure also uses heavy lines to illustrate the parabolic reflector 1, with a 0.33-meter diameter, and dots and dashes to show a reflector 1' with a different diameter, for example 0.7 meters. In the same way, to illustrate the setting of the tube orientation, the supporting tube 7 has been shown in three different positions, one with solid lines and the other two dots and dashes, to show the possible angular deflection of the system.

The invention is not restricted to the embodiments described and shown. In particular the source has been shown in the figures as a simple helicoidal radiator having an unoccupied end. This type of source is perfectly well suited to cicularly polarized transmissions from a satellite such as the TDF 1. Naturally, this device is not restrictive, and the source will be adapted to the mode of polarization of the satellite transmissions. Thus while the polarization for transmission from the satellite TDF 1 is circular, the polarization for the transmission received from the ASTRA satellite is designed to be horizontal and vertical. Similarly, some satellites will transmit in two polarization modes, left-hand and right-hand. The corresponding sources will be adapted to these different types of polarization.

The radome-forming tube 4 can be made of a material other than polypropylene, provided that this material creates no losses.

The structure thus obtained for the antenna system is particularly compact and very easy to set up. All the proofing is done in the factory and no special precautions are necessary during installation.

What is claimed is:

1. An antenna system for direct broadcasting satellite reception, comprising:

a parabolic reflector, having a central axis;

a supporting foot formed of a hollow tubular body having a first end and a second opposite end and having a central axis extending along a lengthwise portion of said tubular body;

a centering piece rigidly affixed to a rear central part of said parabolic reflector and to said first end of said tubular body to connect said parabolic reflector to said tubular body such that said central axis of said tubular body is always orthogonal to said central axis of said reflector;

a cylindrical tube, passing through the reflector and the centering piece and having a central axis which is the same as the central axis of the reflector, said tube including a source along said central axis;

a pedestal arranged along a horizontal axis, and holding said second end of said tubular body, rotatable around a vertical axis which is perpendicular to said horizontal axis to set an azimuth of the antenna system;

means, coupled to said second end of hollow tubular body and to said pedestal, for hinging and locking the tubular body with respect to said pedestal, enabling the antenna system to swivel around a horizontal axis for fixing an elevation of the antenna system; and a plurality of circuits for the antenna system, which circuits are fixed to an interior of the tubular body of the supporting foot.

2. An antenna system according to claim 1, further comprising a tube used as a support, wherein the pedestal is a tube of a size designed to be fitted directly in said tube used as a support.

3. An antenna system according to claim 1, wherein the pedestal is formed by two parts:

a first part designed to be fixed to a support, a second part that is movable in rotation with respect to the first part around a vertical axis, fixing the azimuth of the antenna system.

4. An antenna system according to claim 3, wherein the fixed part of the pedestal includes a level indicator defining a reference plane with respect to which the setting of the elevation is obtained with precision.

5. An antenna system according to claim 1, wherein the tubular body of the supporting foot is closed and sealed at its upper part and is open at its lower part.

6. An antenna system according to claim 1 wherein the source is formed by a helicoidal radiator associated with a coaxial cable, the assembly being centered in the cylindrical tube, and the cylindrical tube formed of low loss dielectric.

* * * * *